US006408984B1

(12) United States Patent
Cavagnaro

(10) Patent No.: US 6,408,984 B1
(45) Date of Patent: Jun. 25, 2002

(54) LADDER LEVELING DEVICE

(76) Inventor: Craig T. Cavagnaro, P.O. Box 937, 177 Tamarack Woods Dr., Lakeside, MT (US) 59922

( * ) Notice: Subject to any disclaimer, the term of this patent is extended or adjusted under 35 U.S.C. 154(b) by 0 days.

(21) Appl. No.: 09/812,379

(22) Filed: Mar. 20, 2001

(51) Int. Cl.[7] ..... E06C 7/44
(52) U.S. Cl. ..... 182/205
(58) Field of Search ..... 182/200–205

(56) References Cited

U.S. PATENT DOCUMENTS

| | | | | | |
|---|---|---|---|---|---|
| 63,468 | A | * | 4/1867 | Card | |
| 1,265,636 | A | * | 5/1918 | Farnsworth | 182/205 |
| 1,376,777 | A | * | 5/1921 | O'Connor | 182/203 |
| 3,973,860 | A | * | 8/1976 | Kern | |
| 4,807,720 | A | | 2/1989 | Kim | |
| 5,174,412 | A | | 12/1992 | Vega | |
| 5,222,575 | A | | 6/1993 | Santos | |
| 5,273,133 | A | | 12/1993 | Thocher et al. | |
| 5,307,900 | A | * | 5/1994 | Noga | 182/204 |
| 5,341,899 | A | | 8/1994 | Casamento | |
| 5,464,071 | A | * | 11/1995 | Rice | 182/205 |
| 5,476,153 | A | | 12/1995 | Dickerson et al. | |
| 5,497,850 | A | | 3/1996 | Patterson | |
| 5,669,462 | A | | 9/1997 | Jennings | |
| 5,695,164 | A | * | 12/1997 | Hartmann | |
| 5,853,065 | A | | 12/1998 | Hutson et al. | |
| 6,234,273 | B1 | * | 5/2001 | Moore | 182/201 |

FOREIGN PATENT DOCUMENTS

| | | | | |
|---|---|---|---|---|
| IT | 573182 | * | 2/1958 | 187/204 |

* cited by examiner

*Primary Examiner*—Alvin Chin-Shue
(74) *Attorney, Agent, or Firm*—Dale J. Ream

(57) ABSTRACT

A ladder leveling device includes a support sleeve having a platform and a pair of clamp arms for supporting and selectively tightening a support leg of a ladder thereto. The clamping arms are slidably coupled to the support sleeve and are movable in opposed directions according to a rack and pinion gear arrangement connecting the clamp arms with a crank handle. The device includes a leveler leg positioned for vertical movement within the support sleeve. The leveler leg includes a second rack gear and a second crank handle rotatably coupled to the support sleeve. A second pinion gear is coupled to the second crank handle and positioned to engage the second rack gear for translating the rotational movement of the second crank handle into linear movement of the leveler leg relative to the support sleeve. A sight level is mounted to the support sleeve.

2 Claims, 6 Drawing Sheets

LADDER LEVELING DEVICE

BACKGROUND OF THE INVENTION

This invention relates generally to ladder leveling devices and, more particularly, to a device for supporting and selectively tightening a leg of a ladder to a support sleeve and for selectively adjusting the vertical position of a ladder leg according to a sight level.

A common problem faced by persons using a ladder is placing the ladder upon a completely level support surface. When a level surface cannot be located, users too often attempt to prop up a ladder support leg with any available item, such as boards or bricks, or to simply use the ladder in an uneven configuration. Obviously, using a ladder in either of these instances is dangerous.

Various devices have been proposed in the art for leveling a ladder. Although assumably effective for their intended purposes, existing devices are typically required to be attached to a ladder with fasteners, do not adequately support a ladder leg, or still require the user to estimate the proper adjustment to make the ladder level.

Therefore, it is desirable to have a ladder leveling device that includes a platform that supports the foot of a ladder support leg and includes clamping arms for selectively tightening the support leg to the device. Further, it is desirable to have a ladder leveling device that includes a bubble-type sight level for establishing a proper device adjustment. Finally, it is desirable to have a ladder leveling device which requires no additional hardware for attachment to a ladder and which does not damage the ladder.

SUMMARY OF THE INVENTION

A ladder leveling device according to the present invention includes a generally rectangular support sleeve having a platform adapted to support a foot of a support leg of a ladder. The support sleeve further includes a pair of clamping arms for selectively tightening a ladder support leg to the support sleeve. Each clamping arm is slidably coupled to the support sleeve and integrally includes a rack gear. A crank handle is connected to a shaft that extends through an outer side wall of the support sleeve and is rotatably coupled to an inner side wall thereof. A pinion gear is mounted about the shaft and positioned for engagement with the clamping arm rack gears such that the clamping arms are concurrently moved in opposite directions upon a rotation of the crank handle.

The ladder leveling device further includes a leveler leg positioned for vertical movement within the support sleeve. Another rack gear is mounted to the leveler leg. Another crank handle is connected to a shaft that extends through the outer side wall of the support sleeve and is rotatably coupled to the inner side wall thereof. Another pinion gear is mounted to the shaft and positioned for engagement with the leveler leg rack gear such that rotation of the crank handle causes the rack and pinion gear assembly to move the leveler leg vertically relative to the support sleeve. Both rack and pinion gear assemblies include a pawl for holding the pinion gears in user-selectable positions, each pawl being releasable by a user from engagement with a respective pinion for allowing opposing movement of respective rack gears. A bubble-type sight level is mounted on the outer side wall of the support sleeve so that a user can determine if he has properly adjusted the leveler leg to place the ladder in a completely level configuration.

Therefore, a general object of this invention is to provide a device for leveling a ladder which may be attached to a support leg of a ladder without additional hardware or tools.

Another object of this invention is to provide a device, as aforesaid, which includes a platform for supporting the foot of a ladder support leg.

Still another object of this invention is to provide a device, as aforesaid, which includes clamp arms for selectively tightening a ladder support leg to a support sleeve.

Yet another object of this invention is to provide a device, as aforesaid, in which the tightness of the clamping arms or the vertical configuration of a leveler leg are adjustable with rack and pinion gear assemblies.

A further object of this invention is to provide a device, as aforesaid, in which the leveler leg includes a pivotal foot.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
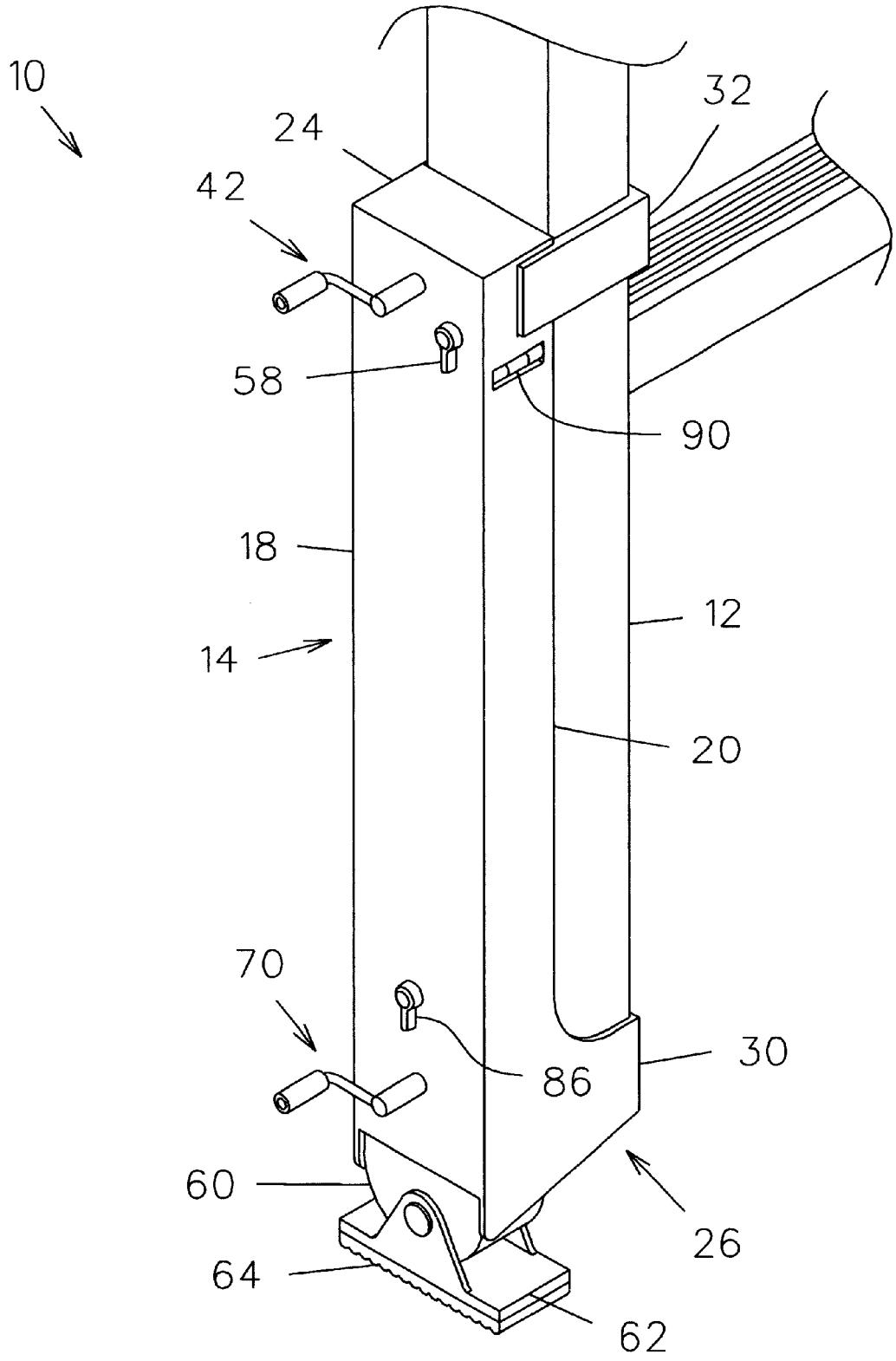
FIG. 1 is a fragmentary perspective view of a ladder leveling device according to a preferred embodiment of the present invention coupled to a support leg of a ladder with the leveler leg in a retracted configuration.
Figure 2:
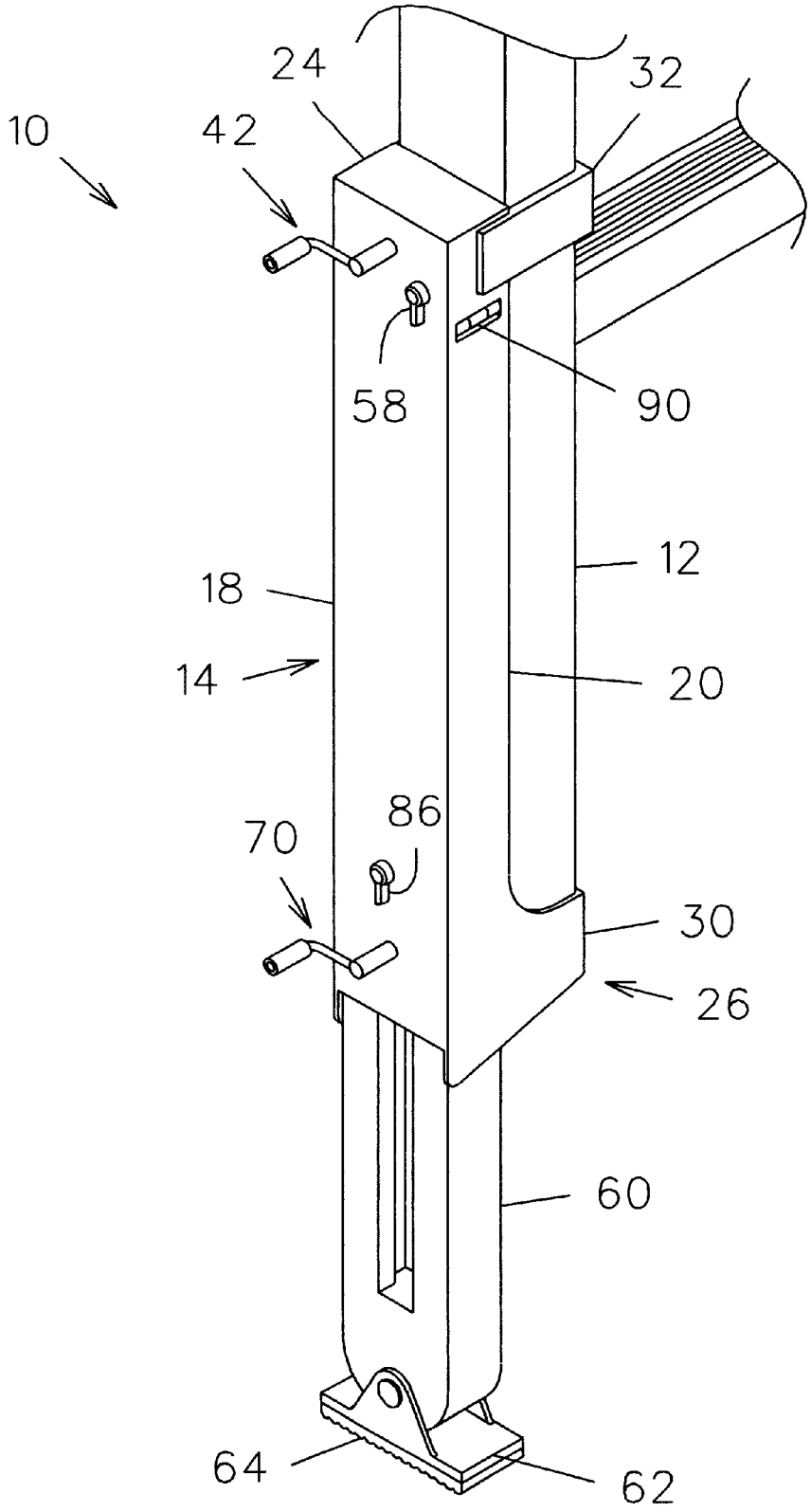
FIG. 2 is a perspective view of the device as in FIG. 1 with the leveler leg in an extended configuration.
Figure 3:
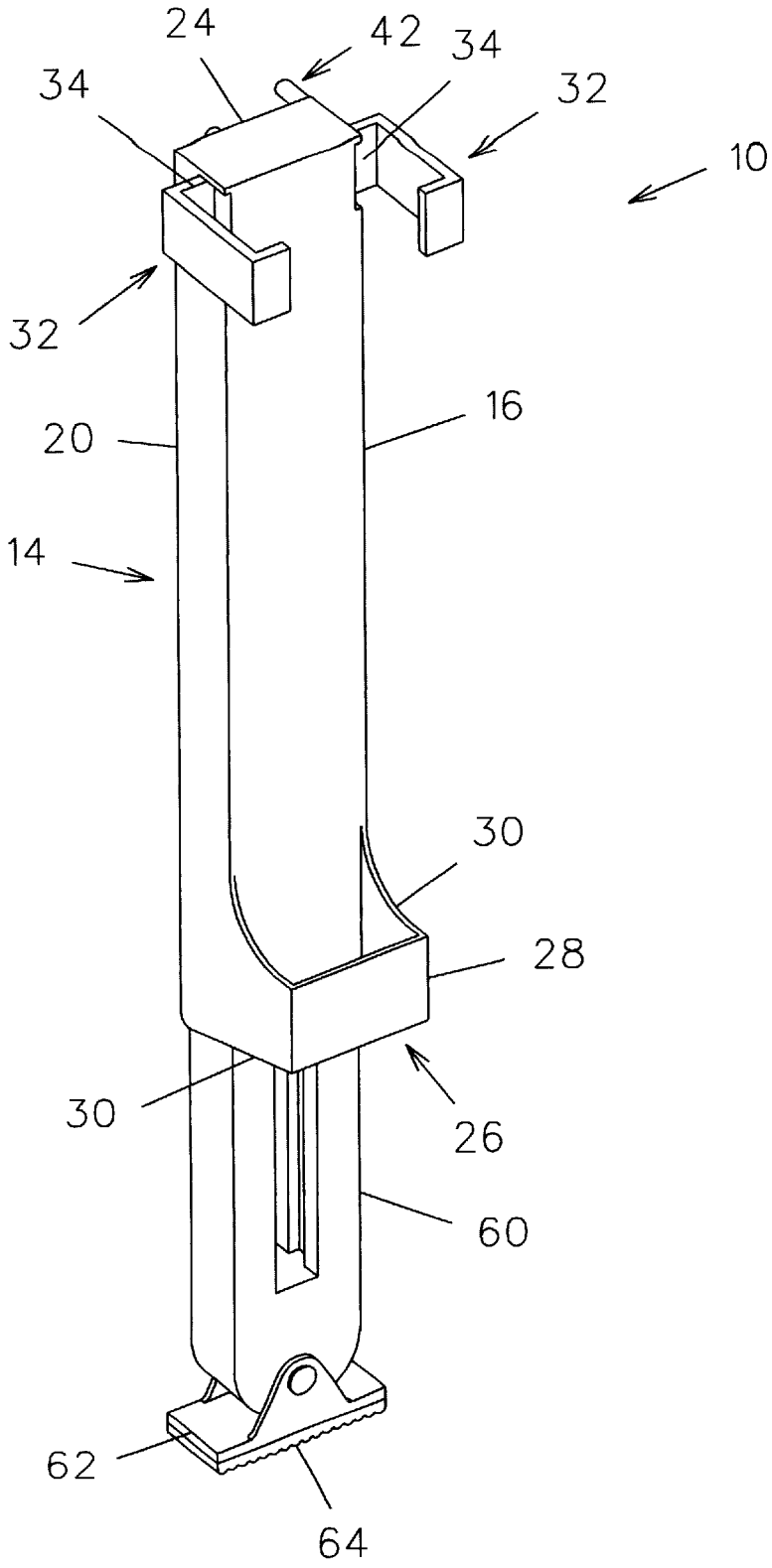
FIG. 3 is another perspective view as in FIG. 2 with the device removed from the ladder.
Figure 4:
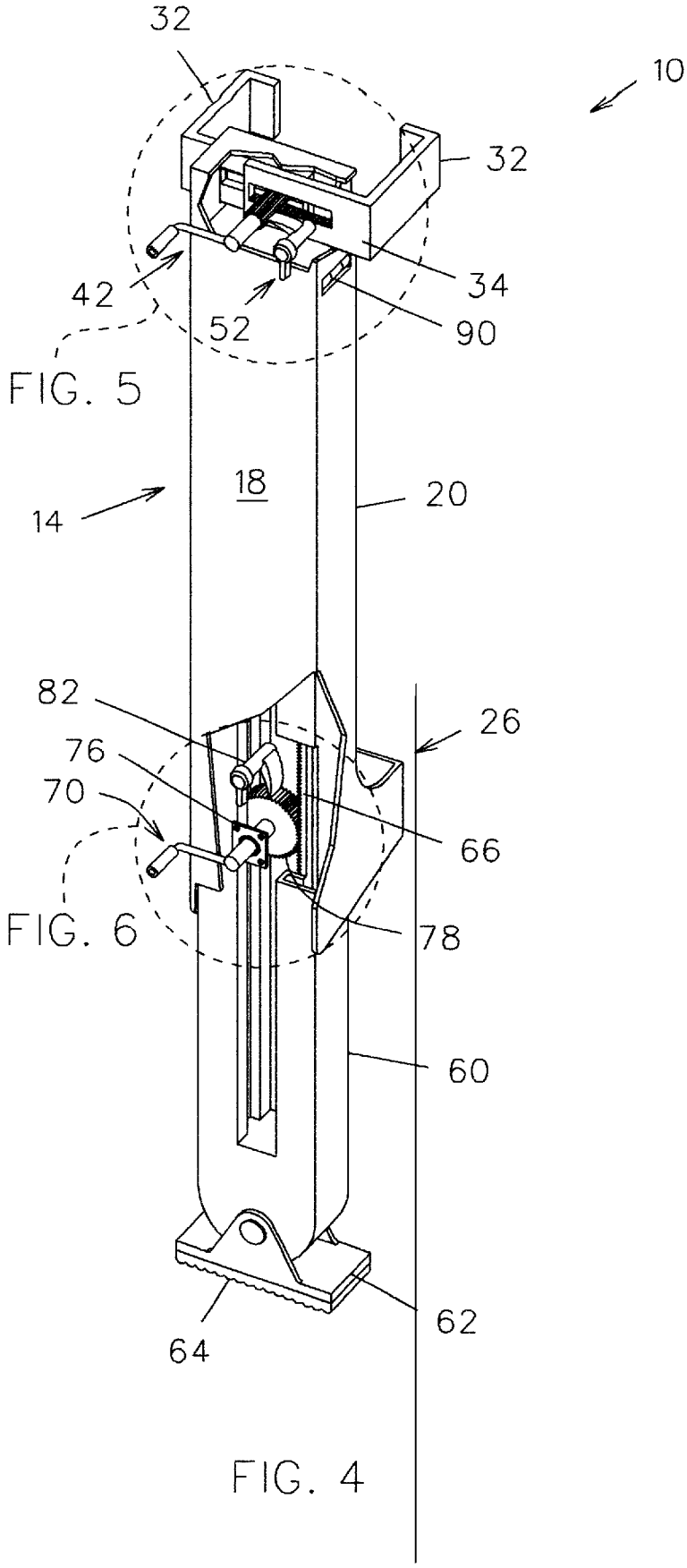
FIG. 4 is another perspective view of the device as in FIG. 2 with portions of the support sleeve broken away to show first and second rack and pinion gear assemblies.

A ladder leveling device 10 according to the preferred embodiment of the present invention will now be described with reference to FIGS. 1–6 of the accompanying drawings. The ladder leveling device 10 includes a support sleeve 14 having a generally rectangular configuration and including parallel inner 16 and outer 18 upstanding side walls with upstanding front 20 and rear 22 walls intermediate the side walls (FIGS. 1 and 3). The support sleeve 14 includes a closed top 24 and defines an open bottom. A generally rectangular platform structure 26 integrally extends from said inner side wall 16 and is normal thereto and adjacent to the open bottom (FIG. 3). The platform structure 26 includes a platform bottom (not shown) and a front guide wall 28 extending vertically from the platform bottom and parallel to the inner side wall 16 of the support sleeve 14. The platform structure 26 includes opposed upstanding side guide walls extending between the front guide wall 28 and inner side wall 16. The platform structure 26 is configured to support the pivotal foot of a ladder support leg 12 and to stabilize the foot so that it does not slide off the platform bottom (FIGS. 1 and 2).

Figure 5:
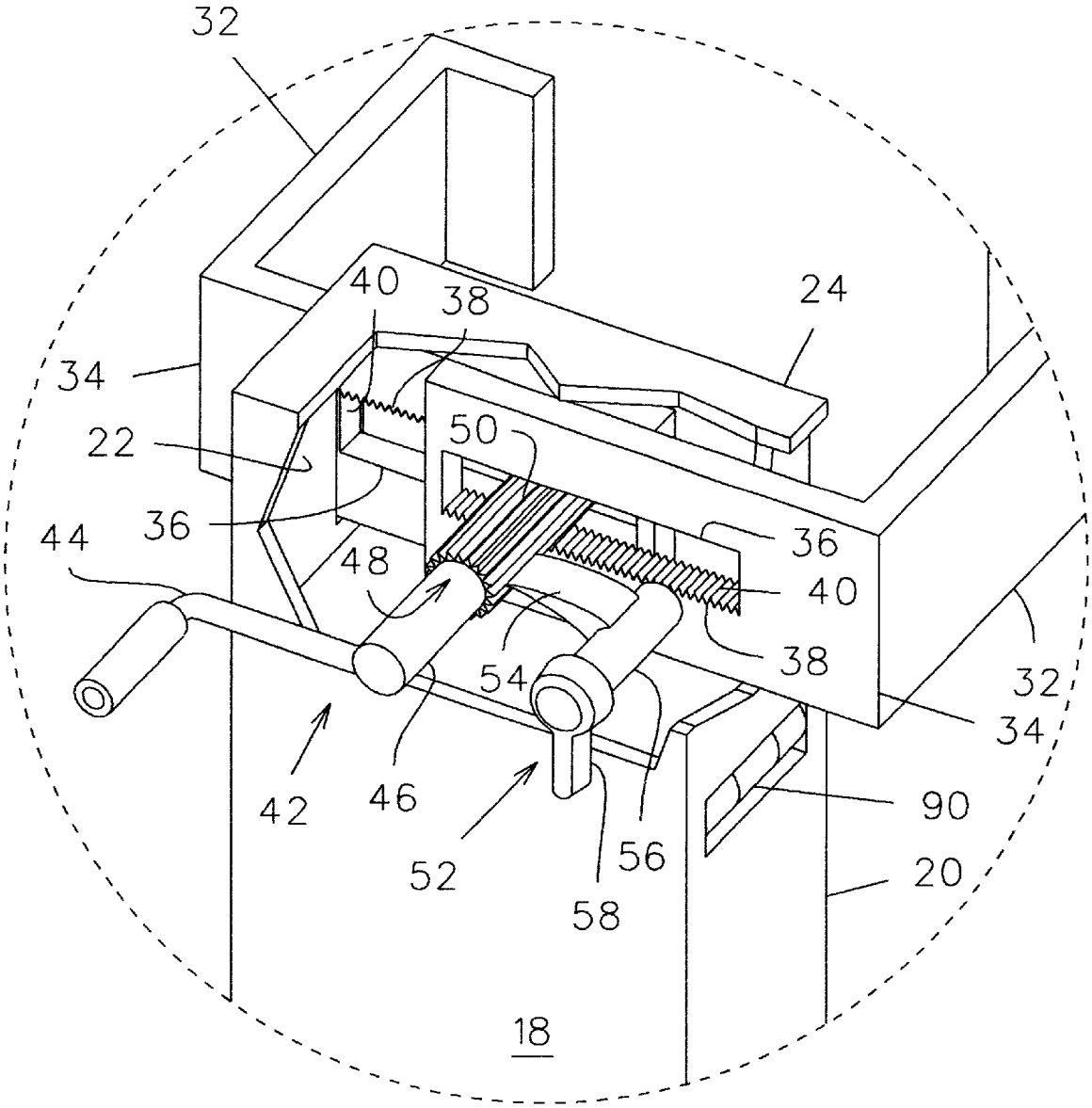
FIG. 5 is an isolated view on an enlarged scale of the clamping arms rack and pinion gear assembly as in FIG. 4.

The support sleeve 14 further includes a pair of generally U-shaped clamping arms 32 (FIG. 3). Each clamping arm 32 may include a neoprene inner layer (not shown) to ensure a frictional grip. Each clamping arm 32 includes a support portion 34 slidably extending through a vertical slot in respective front and rear walls of the support sleeve 14. Each support portion 34 of a clamping arm 32 defines an elongate slot 36, one edge of which forms a linear rack gear 38 having a plurality of teeth 40 therealong (FIG. 5). A first crank handle 42 includes an L-shaped crank arm 44 connected to a shaft 46. The shaft 46 extends through the outer side wall 18 of the support sleeve 14 and through the elongate slots 36 of the crank arm support portions 34. The shaft 46 is rotatably coupled preferably to the inner side wall 16 with a bearing coupling or the like although the shaft may alternatively be coupled to the outer side wall 18 in similar fashion. A cylindrical pinion gear 48 having a plurality of teeth 50 is fixedly mounted about the shaft 46 such that its teeth are positioned in mating engagement with the teeth of the crank arm rack gears 38 (FIG. 5). Therefore, as the crank arm 44 is operated by a user, the shaft 46 is rotated which, in turn, causes an operation of the rack and pinion gear assembly. In other words, this rack and pinion gear assembly translates the rotational movement of the crank handle 42 into linear frontward or backward movement of the clamping arms 32 relative to the front 20 and rear 22 walls of the support sleeve 14. It should be appreciated that the clamping arms 32 move concurrently in opposed directions upon rotation of the crank handle 42 in a manner substantially similar to a vise.

The rack and pinion gear assembly for the clamping arms 32 includes a hold/release mechanism 52 having a pawl 54 fixedly attached to a rod 56 that is rotatably mounted to one of the clamp arms 32 (FIG. 5). The pawl 54 engages the pinion gear teeth 50 so as to hold the pinion gear 48 at a user-selected position. The rod 56 of the hold/release mechanism extends outwardly through the outer side wall 18 of the support sleeve 14 and includes a lever 58 whereby a user may manually rotate the rod 56 to release the pawl 54 from engagement with the pinion teeth 50. This releases the pinion gear 48 from the user selected position and allows the clamping arms 32 to be moved in an opposed direction upon a corresponding rotation of the crank handle 42.

Figure 6:
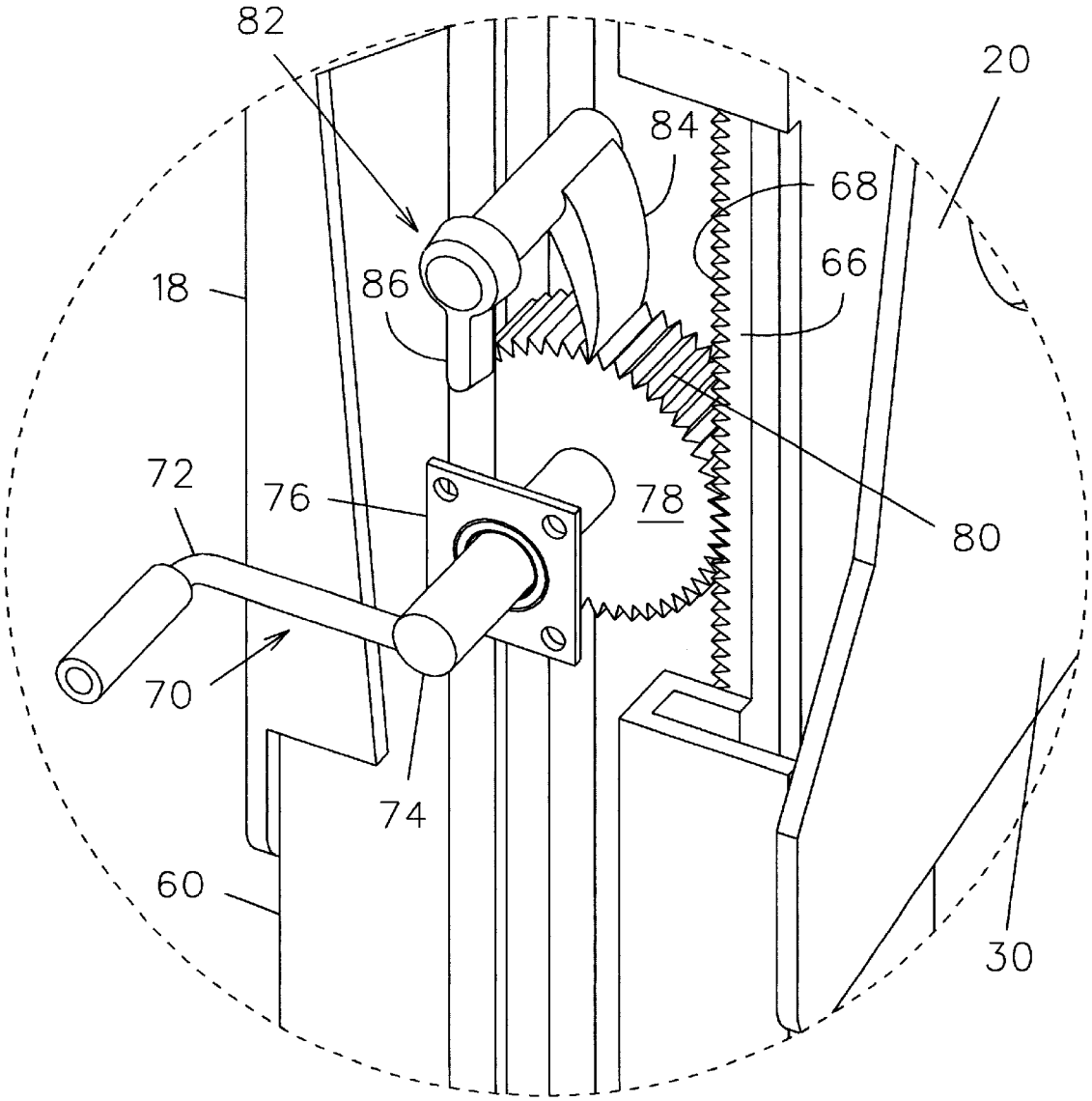
FIG. 6 is an isolated view on an enlarged scale of the leveler leg rack and pinion gear assembly as in FIG. 4.

The ladder leveling device 10 further includes a leveler leg 60 coupled to the support sleeve 14 for vertical movement therein. The leveler leg 60 includes a foot 62 pivotally attached to a distal end thereof relative to the support sleeve 14 (FIG. 2). A resilient pad 64 is attached to the bottom side of the foot 62, such as a rubber pad defining a tread for gripping a support surface. Another rack and pinion gear assembly is utilized to couple the leveler leg 60. to the support sleeve 14 for vertically adjusting the leveler leg 60 relative thereto. Accordingly, the leveler leg 60 includes an upstanding rack gear 66 having a plurality of teeth 68 (FIG. 6). This rack and pinion gear assembly also includes a crank handle 70 having an L-shaped crank arm 72 attached to a shaft 74 in a construction substantially similar to the crank handle 42 described previously. The shaft 74 is rotatably coupled to a flange bearing 76 that is fixedly attached to the outer side wall 18 of the support sleeve 14 (FIG. 6) and thus is rotatable upon an operation of the crank arm 72. A pinion gear 78 having a plurality of teeth 80 is fixedly attached to an end of the shaft 74 and configured such that the pinion teeth 80 and rack teeth 68 are in mating engagement. Therefore, a rotation of the crank handle 70 causes vertical movement of the leveler leg 60 relative to the support sleeve 14, i.e. to extend or retract the leg.

This second rack and pinion assembly also includes a hold/release mechanism 82 having a construction substantially similar to the hold/release mechanism 52 described previously. Thus, a pawl 84 engaged the pinion teeth 80 holds the pinion gear 78 at a user-selected position unless a user operates a lever 86 to manually release the pawl 84.

A conventional bubble-type sight level 90 is mounted in a recessed space on the front wall 20 of the support sleeve 14 such that a user may determine whether the leveler leg 60 needs to be extended or retracted in order to achieve complete leveling of a ladder (FIG. 5).

In use, the ladder leveling device 10 may be coupled to a ladder support leg 12 when the ladder is laying on the ground or even when the ladder is vertically positioned. The support sleeve 14 may be positioned such that a ladder support leg 12 is slidably received between the clamping arms 32 until the foot or end of the ladder bears against the platform bottom of the platform structure 26 (FIG. 1). Then, the crank handle 42 of the first rack and pinion gear assembly may be rotated to selectively tighten the clamp arms 32 about the support leg 12. The crank handle 42 of the second rack and pinion gear assembly 70 may also be rotated to selectively extend the leveler leg 60 from the support sleeve 14. Once the leveler leg 60 has been extended to a position estimated by a user to be level, the user may view the bubble-type sight level 90 to verify the vertical adjustment. The crank handle 70 of the leveler leg rack and pinion gear assembly may then be further rotated in conjunction with viewing the sight level 90 for precise leveling. Being able to vertically adjust the leveler leg 60 without removing the device 10 from the ladder support leg 12 is a significant advantage over existing devices. To retract the leveler leg 60 into the support sleeve 14 or to loosen the clamp arms 32 from about a ladder support leg 12, the user may rotate respective release levers 52, 82 and operate the corresponding crank handle 42, 70 in an opposite direction.

While the present drawings illustrate use of this device 10 with an extension ladder, the clamping arms 32 make this device useful with a stepladder as well.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A device for leveling a ladder having at least a pair of support legs, comprising:

a ladder support sleeve having a generally rectangular configuration with inner and outer side walls and front and rear walls intermediate said side walls, said support sleeve having a closed top and defining an open bottom;

a platform integrally extending from said inner side wall of said support sleeve, said platform being normal to said inner side wall and adjacent said open bottom, said platform including a front guide wall parallel to said inner side wall and a pair of side guide walls intermediate said front guide wall and said inner side wall, said front and side guide walls adapted to stabilize a foot of a ladder support leg upon said platform;

first and second opposed U-shaped clamp arms coupled to said support sleeve adjacent said closed top and adapted to receive said ladder support leg therebetween, said clamp arms adapted to move concurrently in opposed frontward and backward directions relative to said front and rear walls of said support sleeve;

wherein each clamp arm includes an inner layer constructed of neoprene material adapted to frictionally grip said support leg of a ladder;

a first rack gear integrally attached to said first clamp arm and having a plurality of teeth;

a first crank handle having a shaft rotatably coupled to said support sleeve and extending normally across said first rack gear;

a first pinion gear fixedly mounted to said first crank handle shaft and having a plurality of teeth positioned for engagement with said first rack teeth, whereby said first clamp arm is moved in a linear direction upon a corresponding rotation of said first crank handle;

means for maintaining said first pinion gear at a user-selectable position relative to said first rack gear;

a sight level mounted to said support sleeve;

a leveler leg coupled to said support sleeve for movement in first and second opposed directions within said support sleeve;

means for vertically adjusting said leveler leg relative to said support sleeve, said adjusting means comprising:

a second rack gear vertically mounted within said leveler leg, said second rack gear having a plurality of teeth;

a second crank handle having a shaft extending through said outer side wall of said support sleeve and being rotatably coupled to said outer side wall thereof;

a second pinion gear fixedly mounted to said second crank handle shaft and having a plurality of teeth, said second pinion gear being positioned such that said second pinion gear teeth engage said second rack gear teeth for translating rotation of said second crank handle into respective vertical movement of said leveler leg relative to said support sleeve;

means for maintaining said second pinion gear at a user-selectable position relative to said second rack gear;

a foot pivotally connected to a distal end of said leveler leg relative to said support sleeve; and a resilient pad attached to a bottom surface of said foot.

2. The device as in claim 1 further comprising:

means for releasing said first pinion gear from said user-selectable position relative to said first rack gear; and means for releasing said second pinion gear from said user-selectable position relative to said second rack gear.

* * * * *